US007810574B2

(12) United States Patent
Stukey et al.

(10) Patent No.: US 7,810,574 B2
(45) Date of Patent: Oct. 12, 2010

(54) SUBMERSIBLE PUMP PULLER AND METHOD OF USE

(76) Inventors: Gaylen R. Stukey, 2510 Itasca Rd., Plainview, TX (US) 79072; Leland P. Stukey, P.O. Box 1365, Plainview, TX (US) 79073

( * ) Notice: Subject to any disclaimer, the term of this patent is extended or adjusted under 35 U.S.C. 154(b) by 456 days.

(21) Appl. No.: 12/041,417

(22) Filed: Mar. 3, 2008

(65) Prior Publication Data

US 2009/0218106 A1 Sep. 3, 2009

(51) Int. Cl.
*E21B 19/08* (2006.01)

(52) U.S. Cl. ..... 166/384; 166/77.2; 242/399.1; 242/399.2; 242/403

(58) Field of Classification Search ..... 166/384, 166/385, 77.2; 242/339.1, 399.2, 403, 403.1, 242/557; 254/323, 324, 325
See application file for complete search history.

(56) References Cited

U.S. PATENT DOCUMENTS

| | | | | |
|---|---|---|---|---|
| 3,116,781 | A | 1/1964 | Rugeley et al. | 153/54 |
| 3,589,642 | A | 6/1971 | Blagg | 242/157 |
| 4,188,997 | A | 2/1980 | Ainsworth | 166/77 |
| 4,296,916 | A | 10/1981 | Jewett | 254/380 |
| 4,523,645 | A | 6/1985 | Moore | 166/385 |
| 4,673,035 | A | 6/1987 | Gipson | 166/77 |
| 4,767,073 | A * | 8/1988 | Malzacher | 242/414 |
| 4,986,351 | A | 1/1991 | Bowers | 166/85 |
| 5,848,641 | A | 12/1998 | Epp | 166/77.2 |
| 5,996,971 | A | 12/1999 | Crouse | 254/371 |
| 6,502,641 | B1 | 1/2003 | Carriere et al. | 166/384 |
| 6,543,713 | B1 * | 4/2003 | Frolander et al. | 242/399.1 |
| 7,152,672 | B1 * | 12/2006 | Gipson | 166/77.2 |
| 7,708,058 | B1 * | 5/2010 | Gipson | 166/77.2 |

* cited by examiner

*Primary Examiner*—David J Bagnell
*Assistant Examiner*—Robert E Fuller
(74) *Attorney, Agent, or Firm*—Charles D. Gunter, Jr.

(57) ABSTRACT

An apparatus is shown for installing a pulling a submersible pump from a well bore where the pump is supported on a length of flexible tubing. The apparatus has a pivot frame located on a transportable base frame. A take up reel for the flexible tubing is also supported on the pivot frame by a pair of pivoting support arms. The take up reel is centered over the well bore by pivoting the reel on the support arms between a collapsed and a vertical work position. The reel can be further centered by pivoting the pivot frame in a horizontal plane relative to the base frame.

12 Claims, 5 Drawing Sheets

SUBMERSIBLE PUMP PULLER AND METHOD OF USE

BACKGROUND OF THE INVENTION

1. Field of the Invention

The present invention relates generally to a well apparatus for reeving flexible tubing into and out of a well bore and, more specifically to an apparatus for raising and lowering of a submersible pump from a well bore where the pump is run on a length of flexible tubing.

2. Description of the Prior Art

Modern water wells are drilled into the ground with the well bore either being uncased, or being protected by a casing which is sunk into the well. Typically, a submersible pump is then run down the well bore on flexible tubing and submerged in water located at the bottom of the well. The pump provides water to the surface through the flexible tubing which is connected to the pump and which leads up the well bore to the well surface. Although various types of flexible tubing are known, the most commonly used tubing today is a polyolefin, such as polyethylene. In certain of the prior art practices, a separate safety rope or cable is also provided, connected to the pump and extending the length of the bore to assist in withdrawal of the submersible pump from the well bore if the pipe were to separate or break. In addition, since the submersible pump is electrically driven, a power cord or cable also typically extends from the well surface down the bore to the pump where it is attached to the flexible tubing, as by taping the cable to the tubing.

In wells which have submersible pumps for pumping water up through long flexible plastic tubing of the type which has been described (hereafter "well flexible tubing"), tubing installation and removal has tended to be a difficult operation since these procedures are labor intensive and time consuming. A "Pump Setting Rig" or tower crane can be employed, but these solutions are expensive and involve relatively complicated pieces of equipment. These solutions may also be less than optimum because they do not allow the devices to be easily transported from one well location to another to service a plurality of different wells.

There are various reasons why it is necessary to pull the well tubing from the well bore. On occasion, it is necessary to access the submersible pump, either for servicing or replacement, or because the pump must be relocated at a different elevation in the well bore. In the past, when removal of the submersible pump was necessary, often the pump had to be physically removed from the well bore as by raising the pump by the flexible water pipe or tubing. Since well bores can be hundreds of feet deep, this results in hundreds of feet of length of the flexible water pipe and associated electrical wiring which must be accommodated. In the past, the tubing and associated electrical wiring were sometimes simply laid on the ground. This was not a satisfactory solution, however, since this practice is unsanitary and can lead to contamination of the well when the pump, electrical wiring and safety rope are returned to the well bore.

Removal of submersible pumps, as well as the removal of other types of well production and servicing devices, such as coiled tubing, has previously been accomplished by a variety of methods. In more shallow wells, where the weight of the pump and the flexible water pipe tubing is relatively small, physical manual hoisting of the pump and pipe has sometimes been used.

In addition, various mechanical devices have been developed over the years for removing submersible pumps and for removing other types of well devices. For example, U.S. Pat. No. 6,502,641 to Carriere, et al. shows a coiled tubing rig which includes a frame, a tiltable mast and an injector reel. The mast can be tilted to a position that aligns the coiled tubing with the BOP. However, this device is not used as a device for pulling a submersible pump from a well.

U.S. Pat. No. 4,188,997 is an early patent showing a well pump service apparatus. This patent attempts to align the cable with the well bore by means of a permanent well sheave 16 which is supported by frame members 26. It also appears to be a fixed type installation.

U.S. Pat. No. 5,848,641 shows a well pump puller. Although this reference shows a cylindrical drum 12 and a companion guide 82, it does not appear that the cylindrical drum pivots from the horizontal to a vertical position.

U.S. Pat. No. 3,589,642 shows a device for controlling the fleet angle of a cable being spooled onto a drum. It uses a mast 14 for guiding a well logging apparatus such as the sonde being lowered and raised from a well bore.

U.S. Pat. No. 3,116,781 shows a well workover apparatus including a cylindrical drum 12 and a yoke mechanism 18.

U.S. Pat. No. 3,991,978 shows a submersible pump boom which can be used for pulling or replacing a submersible pump.

U.S. Pat. No. 4,986,351 shows a device used for pump removal which includes a collar which is secured to the upper end of a well casing.

U.S. Pat. No. 4,523,645 shows an apparatus for removing reeved material from a wellbore such as a cable, electrical line or fluid conductor.

U.S. Pat. No. 4,296,916 shows another type of device for pulling submersible pumps from a well bore.

U.S. Pat. No. 4,673,035 is another apparatus which deals with a coil tubing operation. This reference does appear to show a cylindrical drum (25 in FIG. 1) which may be elevated to allow the operation of the apparatus with elevated well heads.

U.S. Pat. No. 5,996,971 shows another type of well pipe hoist which is secured to the well casing at the top of the well.

While the above references, and others, show a variety of device which have been used in the past for raising and lowering flexible tubing from a well bore, a need continues to exist for an improved submersible pump puller which is simple in design and economical to manufacture.

A need also exists for such a device which can be portably mounted for transport from one well location to another.

A need also exists for such an apparatus which evenly centers the vertical axis of the flexible tubing being fed into the well bore over the central vertical axis of the bore hole, so that contact between the flexible tubing and the sides or upper lip regions of the well casing is largely avoided.

SUMMARY OF THE INVENTION

The apparatus of the invention can be used for raising and lowering a submersible pump in a well where the pump is run on a length of flexible tubing. The apparatus includes a portable base frame transportable from one well location to another, the portable base frame being supported in a horizontal plane with respect to a surrounding support surface which may be, for example, a roadway. A pivot frame is mounted on the portable base frame for pivoting movement in a plane generally parallel to the plane of the base frame. The apparatus further includes a pair of oppositely arranged support arms, each of which is pivotally mounted at an inner extent at a pivot point on the pivot frame and having an opposite outer extent. Each support arm has an extension portion which is telescopically mounted with respect to the outer extent of each of the support arms for extension and retraction with respect to the support arms.

A cylindrical take up reel has opposing sides separated by a central region for accumulating the flexible tubing, each of the opposing sides of the cylindrical take up reel being supported on the portable base frame by connection to the extension portion of each of the respective support arms. A primary pivot mechanism has a first extent pivotally attached to the pivot frame and has a second extent pivotally attached to a respective one of the support arms whereby actuation of the primary pivot mechanism serves to pivot the support arm and, in turn, the cylindrical take up reel between a collapsed position on the base frame and an extended, upright position.

A secondary pivot mechanism has a first extent pivotally attached to the base frame and a second extent attached to the pivot frame for pivoting the pivot frame in an arcuate path in a plane generally parallel to the horizontal plane of the pivot frame, whereby the position of the cylindrical drum can be accurately centered with respect to a vertical axis of a well bore to be accessed for raising and lowering the submersible pump into the well bore.

Preferably, the primary and secondary pivot mechanisms are hydraulic cylinders which are actuated by a hydraulic motor associated with the base frame. The flexible tubing is preferably formed of polyethylene. In one version of the apparatus, the extension portion of each support aim has an outermost extent which is connected to a hub which, in turn, is connected to a gear mechanism on either of opposite sides of the take up reel. The gear mechanism is also preferably hydraulically powered by the hydraulic motor.

In the method of using the apparatus of the invention, a pivot frame as described is mounted on a portable base frame which is transportable from one well location to another, the portable base frame being supported in a horizontal plane with respect to a surrounding support surface, and wherein the pivot frame is capable of pivoting movement in a plane generally parallel to the plane of the base frame. In similar fashion, a pair of oppositely arranged support arms are mounted on the pivot frame, each of the support arms being pivotally mounted at an inner extent at a pivot point on the pivot frame and having an opposite outer extent, and wherein each support arm has an extension portion which is telescopically mounted with respect to the outer extent of each of the support arms for extension and retraction with respect to the support arms. A cylindrical take up reel, as has been described, is provided having opposing sides separated by a central region for accumulating the flexible tubing, each of the opposing sides of the cylindrical take up reel being supported on the portable base frame by connection to the extension portion of each of the respective support arms. The apparatus is also equipped with the primary and secondary pivot mechanisms, as has previously been described.

The apparatus, as described, can then be transported to a well site having a well bore with a vertical well axis. Upon arrival at a well site and roughly positioning the base frame relative to the well bore, the primary pivot mechanism is actuated to thereby raise the support arms and, in turn, the take up reel from a collapsed position to a work position which is vertically oriented with respect to the vertical axis of the well bore with the submersible pump being centered up as much as possible with respect to the well bore vertical axis. Next, the secondary pivot mechanism is actuated to thereby cause the pivot frame to move in a desired arcuate path with respect to the horizontal plane of the base frame, thereby further centering the submersible pump and take up reel over the vertical axis of the well bore. The take up reel can then be actuated to thereby dispense a required length of flexible tubing so that the submersible pump is gradually lowered into the well bore;

In order to remove the submersible pump from the well bore, the previously described sequence of events is essentially repeated in the reverse order.

These and other aspects of the invention will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
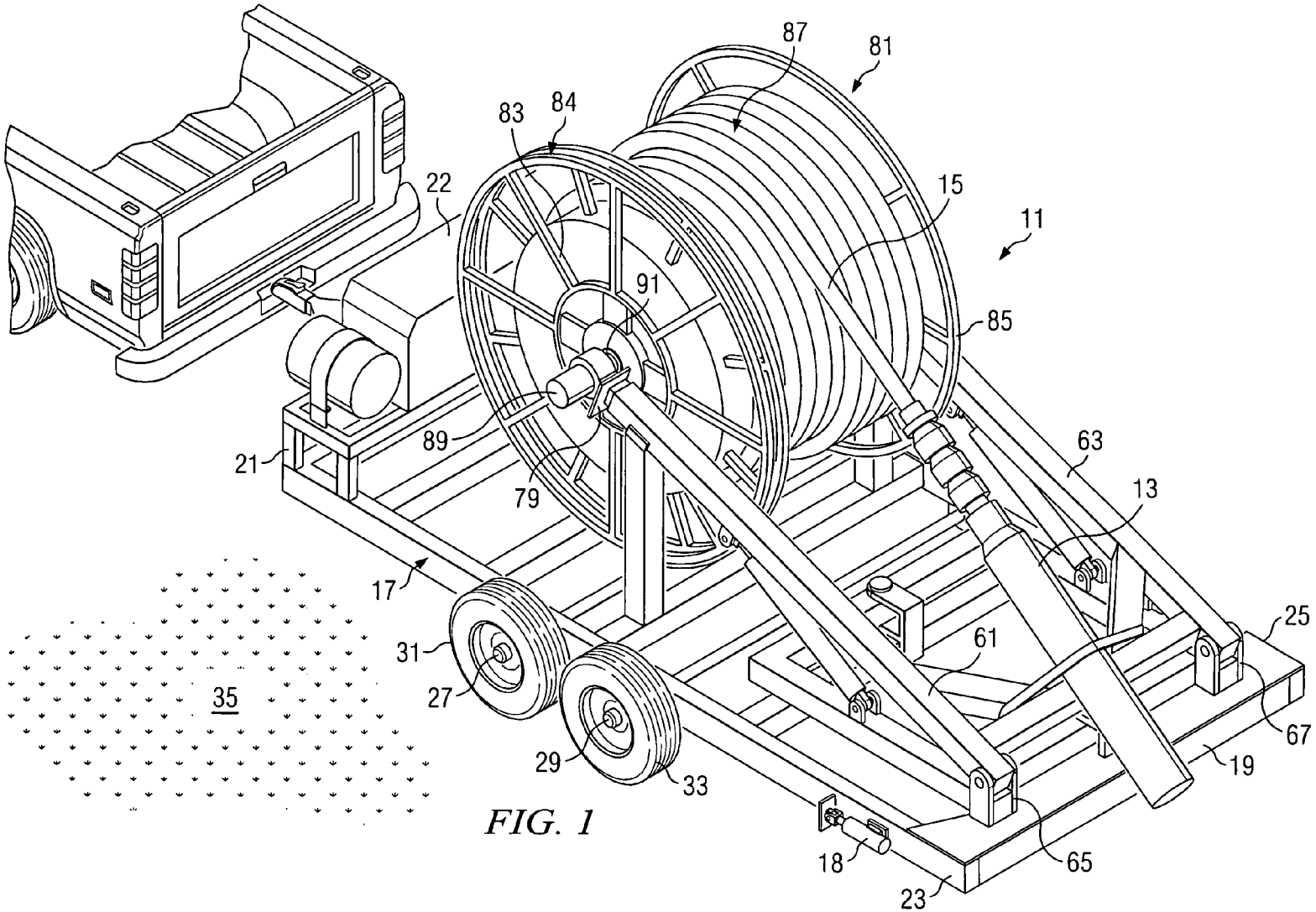
FIG. 1 is a perspective view of the pump pulling apparatus of the invention in the collapsed or transport position with the tubing reel resting upon the base frame.

Turning now to FIG. 1, there is shown an apparatus 11 for raising and lowering a submersible pump 13 in a well bore where the pump is run on a length of flexible tubing 15. In the example illustrated in FIG. 1, the flexible tubing 15 is polyethylene tubing. As will be appreciated from the drawing FIGS. 1 and 4, the apparatus of the invention includes a portable base 17 of a generally polygonal configuration, in this case a rectangular frame. The frame is made up of front and rear elongate members 19, 21, and elongate side members 23, 25. The frame 17 can be made of any convenient sturdy material, e.g., channel iron or the like. As will be appreciated from FIG. 1, the frame 17 is supported on a pair of axles 27, 29 and associated wheels 31, 33, so that the frame can be transported from one well location to another. FIG. 1 shows the frame 17 being towed from the trailer hitch or a pickup. The frame could also be transferred in other ways as, for example, by being skid mounted, or truck or trailer mounted. As also will be appreciated from FIG. 1, the wheels 31, 33 and axles 27, 29 support the frame 17 in a horizontal plane with respect to a surrounding support surface 35, which in this case is a section of roadway. Hydraulic struts or stabilizers 18 are moveable between the retracted position shown in FIG. 1 and the extended position shown in FIG. 4 once the base frame has been temporarily positioned.

Figure 4:
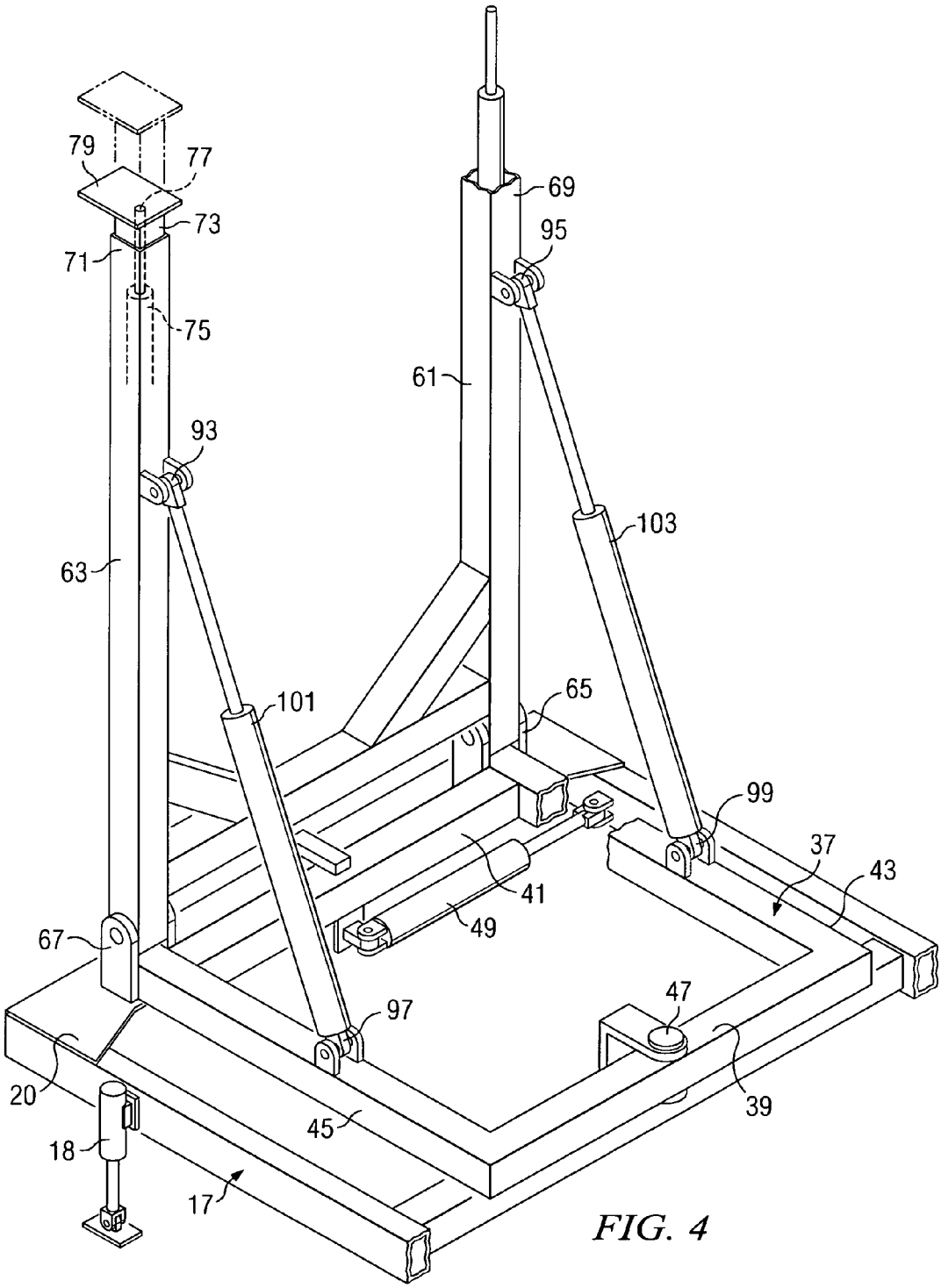
FIG. 4 is an isolated view of the base frame and pivot frame which make up a part of the apparatus of the invention.

As can perhaps best be appreciated from FIG. 4, a pivot frame 37 is mounted on the portable base frame 17 for pivoting movement in a plane generally parallel to the plane of the base frame. The pivot frame 37 is also of a generally polygonal configuration, approximately square, and is made up of front and rear longitudinal elements 39, 41, and side longitudinal elements 43, 35, all formed of welded channel iron. As can be seen from FIG. 4, the pivot frame 37 sits atop the base frame 17 and is connected to the base frame 17 at a pivot point 47 which, in this case, is a type of device arrangement.

The pivotal attachment of the pivot frame 37 to the base frame 17 at the point 47 allows the pivot frame 37 to achieve pivoting movement in a plane generally parallel to the plane of the base frame 17. This pivoting movement of the pivot frame 37 relative to the base frame 17 is illustrated by the darkened arrows in FIG. 5. As can also be seen from FIGS. 4 and 5, a pivot mechanism, in this case hydraulic cylinder 49, has a cylinder body attached at a pivot point 51 to the pivot frame rear member 41. The cylinder 49 also has an output shaft 53 attached at a pivot point 55 to the elongate side member 25 of the base frame 17. A set of rollers 57, 59, mounted at the rear of the pivot frame allow the pivot frame to ride along the top surface of a roller area (20 in FIG. 5) of the base frame elongate rear member 41 during the pivoting action.

The hydraulic cylinder 49, as well as the other hydraulic cylinders used in the apparatus, is of conventional design and is commercially available from a number of convenient sources. It is hydraulically powered by a hydraulic motor (22 in FIG. 1) as will be well understood by those skilled in the relevant arts.

Returning to FIG. 1, it can be seen that a pair of oppositely arranged support arms 61, 63, are each pivotally mounted at an inner extent 65,67, respectively at a pivot point on the pivot frame 37. Each of the support arms also has an opposite outer extent 69, 71. Each support arm 61, 63, has an extension portion, such as portion 73, which is telescopingly mounted with respect to the outer extent 71 of the support arm. In the example of the apparatus illustrated in FIG. 4, the extension portion is a polygonal length of channel iron which is received within the polygonal interior of the respective support arm, e.g., support arm 63. A hydraulic cylinder (shown in phantom lines as 75) has an output shaft 77 which attaches to a bolt plate 79. Actuation of the hydraulic cylinder 75 causes the extension portion 73 of the support arm to extend and retract. This action provides some additional vertical height to a cylindrical take up reel (81 in FIG. 1) if conditions so warrant at the well site being serviced.

The cylindrical take up reel (81 in FIG. 1) has opposing sides 83, 85, and a central region 87 for accumulating the continuous roll of flexible tubing 15. The left side 83 of the take up reel has a double flange (generally at 84 in FIG. 1) which forms a circumferential channel for accommodating a bailing wire. The bailing wire can be used to run a bucket into a water well to clean sand from the well bottom. Each of the opposing sides 83, 85, of the cylindrical take up reel is supported on the portable base flame 17 by connection to the extension portion 73 of each of the respective support arms 61, 63. As can be seen in FIG. 1, the bolt plate 79 of the extension portion of the support arm 61 mounts to a commercially available gear reduction unit. While a variety of commercially available gear reduction units might be utilized, the particular unit illustrated utilizes a planetary gear system in which a hydraulic motor (not shown) drives the center gear of the unit on either side of the take up reel. A ring gear is turned by a set of planetary gears to provide a desired gear reduction. The ring gear is, in turn, attached to the main hub 91 upon which the cylindrical drum 81 is mounted. There is an identical arrangement on the opposite side of the cylindrical drum and hub.

With reference now to FIGS. 1 and 4, it will be seen that the support arms 61, 63 are each pivoted between a retracted or collapsed position, shown in FIG. 1, and the extended or vertical work position shown in FIG. 4 by a primary pivot mechanism. In the example illustrated, the primary pivot mechanism is comprised of hydraulic cylinders 101, 103, which are attached to the pivot frame and to the support arms at pivot points 93, 95, 97, 99, respectively, whereby actuation of the primary pivot mechanism serves to pivot the support arms and, in turn, the cylindrical take up reel between the collapsed position resting on the base frame, and the extended, upright position.

Figure 3:
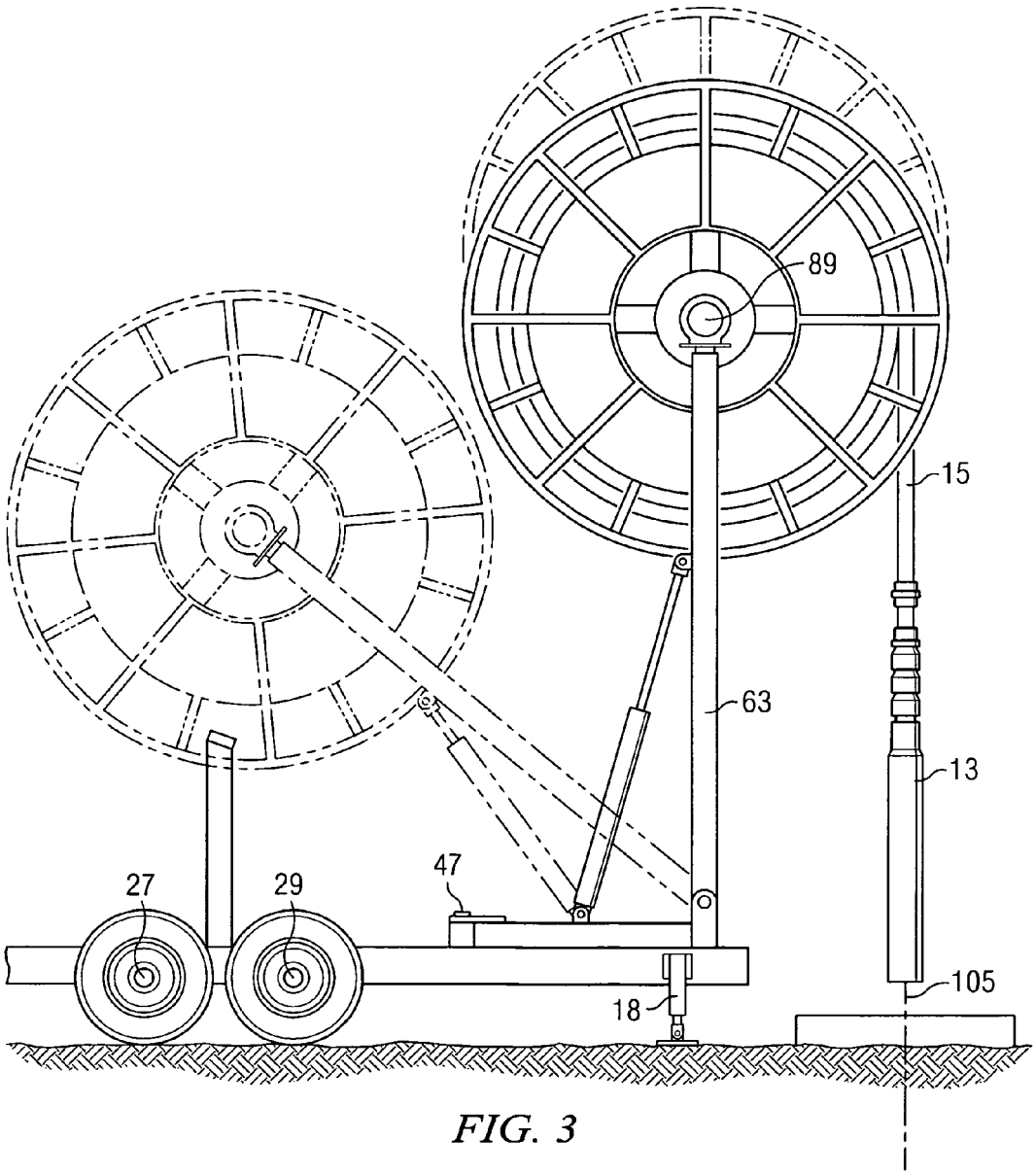
FIG. 3 is another side view of the apparatus of the invention showing the movement of the tubing reel between the vertical, working position in solid lines and the collapsed, or transport position in phantom lines.

In this regard, the hydraulic cylinder 49 running from the base flame 17 to the pivot frame 37 also acts as a secondary pivot mechanism having a first extent pivotally attached to the base frame 17 and a second extent attached to the pivot frame 37 for pivoting the pivot frame 37 in an arcuate path in a plane generally parallel to the horizontal plane of the pivot frame, whereby the position of the cylindrical drum 81 can be accurately centered with respect to a vertical axis of a well bore to be accessed for raising and lowering the submersible pump into the well bore. This vertical axis is illustrated, for example, as 105 in FIG. 3.

Figure 2:
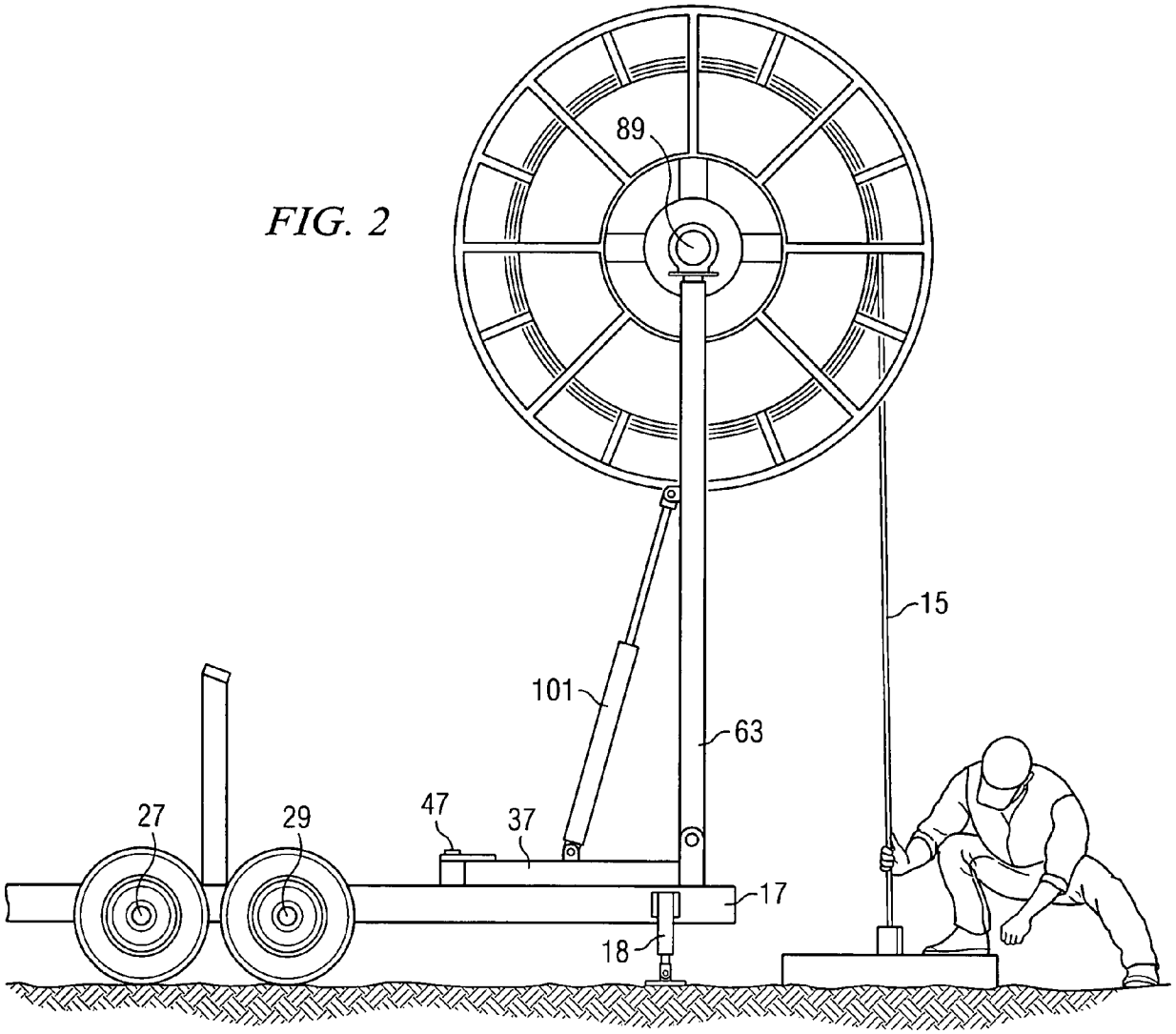
FIG. 2 is a simplified side view of the apparatus of FIG. 1 showing the tubing reel in the vertical, working position and with a workman feeding flexible tubing into the well bore.
Figure 5:
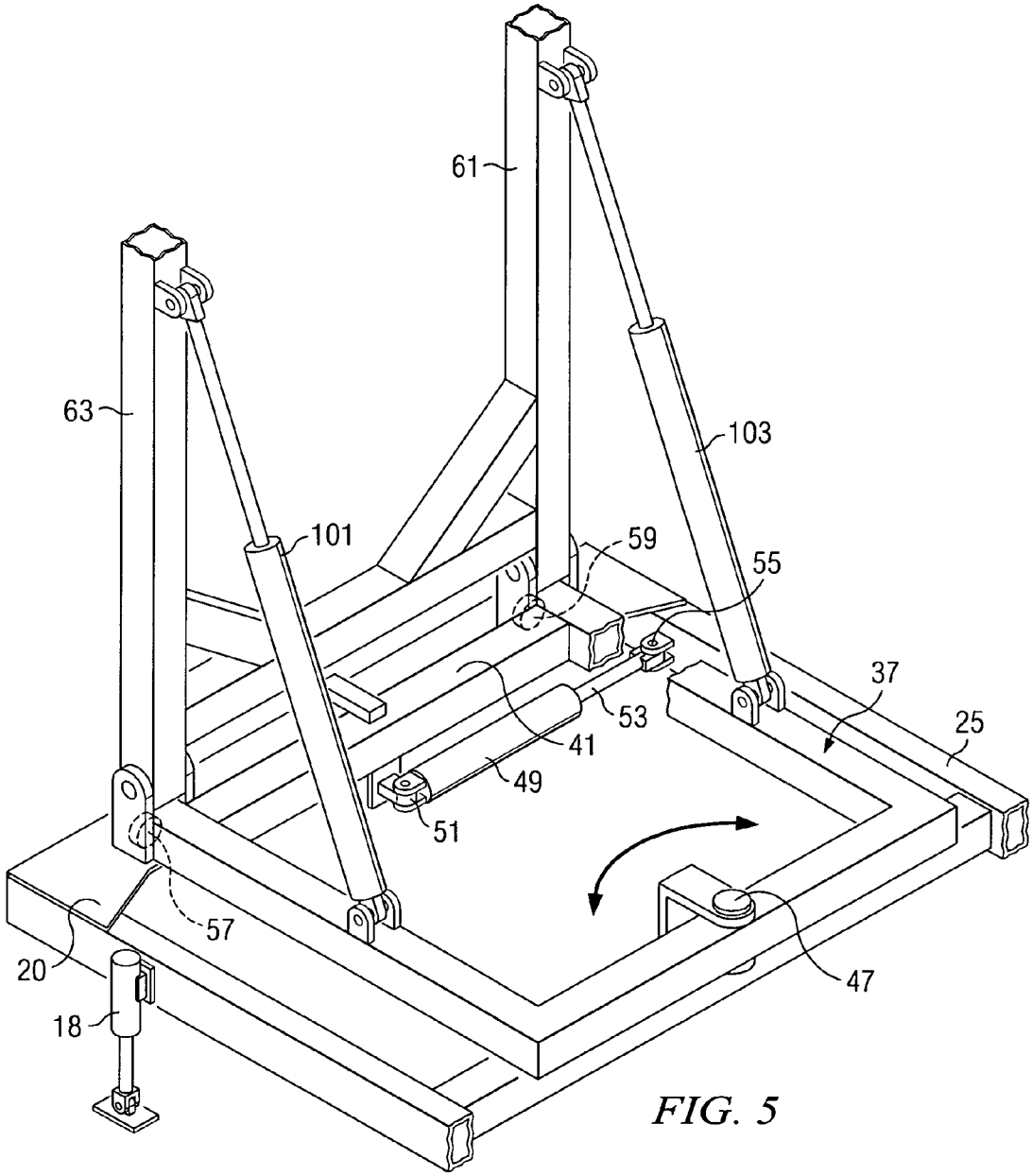
FIG. 5 is an isolated view similar to FIG. 4, but showing the direction of movement of the pivot frame of the invention.

In other words, there are three separate ranges of motion-which can be accomplished by the apparatus of the invention. In the first instance, the support arms 61, 63, and, in turn, the take up reel 81 can be moved in an arcuate path with respect to the base frame 17 and pivot frame 37 to raise and lower the take up reel, as shown in FIGS. 1 and 2. Secondly, the extension portions 73 of the support arms 61, 63 can be hydraulically actuated to further increase the vertical height of the take up reel with respect to the well bore or surrounding support surface (35 in FIG. 1). Thirdly, as shown in FIG. 5, th pivot frame can be moved in the arcuate path shown by the darkened arrows so that the pivot frame 37 moves in a plane generally parallel to the horizontal plane of the base frame 17, to thereby further center the tubing over the well bore.

The general operation of the apparatus of the invention will now be briefly described. The apparatus of the invention can be used in an improved method for lowering and pulling a submersible pump from a well bore where the pump is supported on a length of flexible tubing initially wound up on a take up reel. In the first step of the method, the pivot frame 37 is mounted on the portable base frame 17 which is transportable from one well location to another. The portable base frame 17 is supported in a horizontal plane with respect to a surrounding support surface 35, whereby the pivot frame is capable of pivoting movement in a plane generally parallel to the plane of the base frame.

A pair of oppositely arranged support arms 61, 63, are mounted on the pivot frame 37, each of the support arms being pivotally mounted at an inner extent at a pivot point 65, 67, on the pivot frame and having an opposite outer extent. Each of the support arms 61, 63, is provided with an extension portion 73 which is telescopically mounted with respect to the outer extent of each of the support arms for extension and retraction with respect to the support arms.

A cylindrical take up reel 81 is provided having opposing sides separated by a central region for accumulating the flexible tubing, each of the opposing sides of the cylindrical take up reel being supported on the portable base frame by connection to the extension portion of each of the respective support arms. A primary pivot mechanism (in this case cylinders 101, 103) has a first extent pivotally attached to the pivot frame and has a second extent pivotally attached to a respective one of the support arms whereby actuation of the primary pivot mechanism serves to pivot the support arm and, in turn, the cylindrical take up reel between a collapsed position on the base frame and an extended, upright position.

A secondary pivot mechanism 49 is also provided having a first extent pivotally attached to the base frame and a second extent attached to the pivot frame for pivoting the pivot frame in an arcuate path in a plane generally parallel to the horizontal plane of the pivot frame 37, whereby the position of the cylindrical drum can be accurately centered with respect to a vertical axis 105 of a well bore to be accessed for raising and lowering the submersible pump into the well bore.

In the first step of using the apparatus, the base frame is typically transported to a well site adjacent a well bore having a vertical well axis. The primary pivot mechanism is then actuated to raise the support arms and, in turn, the take up reel from a collapsed position to a work position which is vertically oriented with respect to the vertical axis of the well bore with the submersible pump being centered up as much as possible with respect to the well bore vertical axis.

The position of the take up reel can be further adjusted by actuating the secondary pivot mechanism to thereby cause the pivot frame to move in a desired arcuate path with respect to the horizontal plane of the base frame, thereby further centering the submersible pump and take up reel over the vertical axis of the well bore. If more vertical height is needed over the well bore, the extension portions 73 of the support arms 61, 63 can be extended by actuating the hydraulic cylinders 75.

The take up reel 81 is then actuated to dispense a required length of flexible tubing so that the submersible pump is gradually lowered into the well bore. When the desired depth is reached, the upper end of the flexible tubing is secured at the well head. The preferred primary and secondary pivot mechanisms are both hydraulic piston cylinders which are powered by a hydraulic motor carried on the base frame of the apparatus.

An invention has been provided with several advantages. The submersible pump puller of the invention is simpler in design and less costly to produce than the prior art pump setting rigs and vertical towers. It is not necessary to have a crane present at the well site for the servicing operation. The apparatus of the invention is ideally suited for servicing water wells, but can also be used for other related tasks, such as pumping water off the top portion of a gas or oil well. The three separate degrees of movement of the components of the apparatus provide extremely accurate centering of the take up reel over the well bore being serviced. The apparatus is portable and can easily be transported over a roadway to another well site with only a short take down time being involved.

While the invention has been shown in only one of its forms, it is not thus limited but is susceptible to various changes and modifications without departing from the spirit thereof.

What is claimed is:

1. An apparatus for raising and lowering a submersible pump in a well where the pump is run on a length of flexible tubing, the apparatus comprising:

a portable base frame transportable from one well location to another, the portable base frame being supported in a horizontal plane with respect to a surrounding support surface;

a pivot frame mounted on the portable base frame for pivoting movement in a plane generally parallel to the plane of the base frame;

a pair of oppositely arranged support arms, each of which is pivotally mounted at an inner extent at a pivot point on the pivot frame and having an opposite outer extent, and wherein each support arm has an extension portion which is telescopically mounted with respect to the outer extent of each of the support arms for extension and retraction with respect to the support arms;

a cylindrical take up reel having opposing sides separated by a central region for accumulating the flexible tubing, each of the opposing sides of the cylindrical take up reel being supported on the portable base frame by connection to the extension portion of each of the respective support arms;

a primary pivot mechanism having a first extent pivotally attached to the pivot frame and having a second extent pivotally attached to a respective one of the support arms whereby actuation of the primary pivot mechanism serves to pivot the support arm and, in turn, the cylindrical take up reel between a collapsed position on the base frame and an extended, upright position;

a secondary pivot mechanism having a first extent pivotally attached to the base frame and a second extent attached to the pivot frame for pivoting the pivot frame in an arcuate path in a plane generally parallel to the horizontal plane of the pivot frame, whereby the position of the cylindrical drum can be accurately centered with respect to a vertical axis of a well bore to be accessed for raising and lowering the submersible pump into the well bore.

2. The apparatus of claim 1, wherein the primary and secondary pivot mechanisms are hydraulic cylinders.

3. The apparatus of claim 2, wherein the portable base frame is mounted on at least one axle and wheel set for transport over a roadway.

4. The apparatus of claim 3, wherein the flexible tubing is formed of polyethylene.

5. The apparatus of claim 4, wherein the extension portion of each support arm has an outermost extent which is connected to a hub which, in turn, is connected to a gear mechanism on either of opposite sides of the take up reel.

6. An apparatus for raising and lowering a submersible pump in a water well where the pump is run on a length of flexible polyethylene tubing, the apparatus comprising:

a portable base frame transportable from one well location to another, the portable base frame being supported in a horizontal plane on at least one axle and wheel set for transport of the base frame ver a roadway surface;

a pivot frame mounted on the portable base frame for pivoting movement in a plane generally parallel to the plane of the base frame;

a pair of oppositely arranged support arms, each of which is pivotally mounted at an inner extent at a pivot point on the pivot frame and having an opposite outer extent, and wherein each support aim has an extension portion which is telescopically mounted within an interior space of each support arm for extension and retraction with respect to the support arms;

a cylindrical take up reel having opposing sides separated by a central region for accumulating the flexible tubing, each of the opposing sides of the cylindrical take up reel being supported on the portable base frame by connection to the extension portion of each of the respective support arms;

a primary hydraulic cylinder having a first extent pivotally attached to the pivot frame and having a second extent pivotally attached to a respective one of the support arms whereby actuation of the primary hydraulic cylinder serves to pivot the support arm and, in turn, the cylindrical take up reel between a collapsed position on the base flame and an extended, upright position;

a secondary hydraulic cylinder having a first extent pivotally attached to the base frame and a second extent attached to the pivot frame for pivoting the pivot frame in an arcuate path in a plane generally parallel to the horizontal plane of the pivot frame, whereby the position of the cylindrical take up reel can be accurately centered with respect to a vertical axis of a well bore to be accessed for raising and lowering the submersible pump into the well bore.

7. A method of lowering and pulling a submersible pump from a well bore where the pump is supported on a length of flexible tubing initially wound up on a take up reel, the method comprising the steps of:

mounting a pivot frame on a portable base frame which is transportable from one well location to another, the portable base frame being supported in a horizontal plane with respect to a surrounding support surface, and wherein the pivot frame is capable of pivoting movement in a plane generally parallel to the plane of the base frame;

mounting a pair of oppositely arranged support arms on the pivot frame, each of the support arms bing pivotally mounted at an inner extent at a pivot point on the pivot frame and having an opposite outer extent, and wherein each support arm has an extension portion which is telescopically mounted with respect to the outer extent of each of the support arms for extension and retraction with respect to the support arms;

providing a cylindrical take up reel having opposing sides separated by a central region for accumulating the flexible tubing, each of the opposing sides of the cylindrical take up reel being supported on the portable base frame by connection to the extension portion of each of the respective support arms;

providing a primary pivot mechanism having a first extent pivotally attached to the pivot frame and having a second extent pivotally attached to a respective one of the support arms whereby actuation of the primary pivot mechanism serves to pivot the support arm and, in turn, the cylindrical take up reel between a collapsed position on the base frame and an extended, upright position;

providing a secondary pivot mechanism having a first extent pivotally attached to the base frame and a second extent attached to the pivot frame for pivoting the pivot frame in an arcuate path in a plane generally parallel to the horizontal plane of the pivot frame, whereby the position of the cylindrical take up reel can be accurately centered with respect to a vertical axis of a well bore to be accessed for raising and lowering the submersible pump into the well bore.

8. The method of claim 7, further comprising the steps of:

transporting the base frame to a well site adjacent a well bore having a vertical well axis;

actuating the primary pivot mechanism to raise the support arms and, in turn, the take up reel from a collapsed position to a work position which is vertically oriented with respect to the vertical axis of the well bore with the submersible pump being substantially centered up as much as possible with respect to the well bore vertical axis;

actuating the secondary pivot mechanism to thereby cause the pivot frame to move in a desired arcuate path with respect to the horizontal plane of the base frame, thereby further centering the submersible pump and take up reel over the vertical axis of the well bore.

9. The method of claim 8, further comprising the steps of:

actuating the take up reel to dispense a required length of flexible tubing so that the submersible pump is gradually lowered into the well bore;

affixing an upper end of the flexible tubing to a well head.

10. The method of claim 8, wherein, once the primary pivot mechanism has been actuated to raise the support arms and, in turn, the take up reel from a collapsed position to a work position, that the extension portion of the support arms are also actuated to thereby provide raise the take up reel to a greater relative vertical height over the well bore vertical axis.

11. The method of claim 10, wherein the primary and secondary pivot mechanisms are both hydraulic piston cylinders which are powered by a hydraulic motor carried on the base frame.

12. The method of claim 11, wherein the extension portion of each support arm is telescopingly mounted within an interior space provided in each support arm and wherein a hydraulic cylinder is also mounted in each of the support arm spaces for extending and retracting the extension portion of each support arm.

* * * * *